United States Patent [19]

Gould

[11] Patent Number: 4,985,980

[45] Date of Patent: Jan. 22, 1991

[54] NET FORMING METHOD

[76] Inventor: Christopher E. Gould, 6630 E. Sweetwater Ave., Scottsdale, Ariz. 85254

[21] Appl. No.: 427,775

[22] Filed: Oct. 27, 1989

[51] Int. Cl.[5] ..... B23P 11/02

[52] U.S. Cl. ..... 29/525.1

[58] Field of Search ..... 29/525.1; 206/150, 151; 294/87.2, 160; D6/347

[56] References Cited

U.S. PATENT DOCUMENTS

| | | | |
|---|---|---|---|
| 3,250,564 | 5/1966 | Stern et al. | 206/151 X |
| 3,630,350 | 12/1971 | Bolton | 206/145 |
| 3,744,626 | 7/1973 | Dreyfus | 206/145 |
| 3,778,096 | 12/1973 | Smith | 206/150 X |
| 3,785,484 | 1/1974 | Cunningham | 206/145 X |
| 3,924,738 | 12/1975 | Poupitch | 206/150 |
| 4,190,149 | 2/1980 | Oliff et al. | 206/145 |
| 4,372,598 | 2/1983 | Quelch | 206/145 X |
| 4,487,312 | 12/1984 | Heider | 206/151 X |
| 4,520,924 | 6/1985 | Edwards et al. | 206/150 |
| 4,574,949 | 3/1986 | Rhoads | 206/150 |

FOREIGN PATENT DOCUMENTS

| | | | |
|---|---|---|---|
| 2244785 | 5/1973 | Fed. Rep. of Germany | 206/150 |

*Primary Examiner*—Mark Rosenbaum
*Assistant Examiner*—Frances Chun
*Attorney, Agent, or Firm*—Leon Gilden

[57] ABSTRACT

A method of forming a net is set forth including the steps of providing a beverage container defined by plural pairs of aligned perimeter encompassing circumferential bands to secure beverage containers therewithin. The container includes a series of diametrically aligned straps and buckles for securement of the packages together to form a net, whereafter unutilized straps and bands are severed from the associated bands with securement straps secured at ends of the net to enable securement of the net to support objects.

5 Claims, 4 Drawing Sheets

PRIOR ART

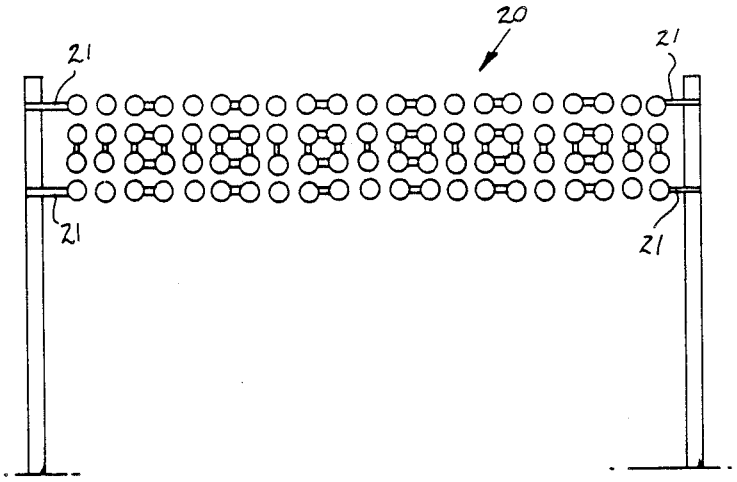
Fig 5
Fig 6
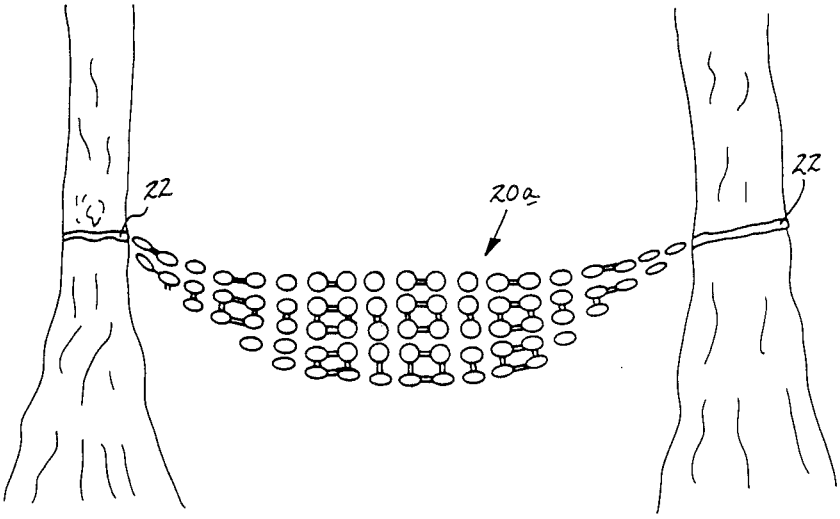

NET FORMING METHOD

BACKGROUND OF THE INVENTION

1. Field of the Invention

The field of invention relates to beverage containers and nets, and more particularly pertains to a new and improved net forming method utilizing an improved beverage container that is securable to successive beverage containers to form a net.

2. Description of the Prior Art

Beverage containers are typically formed of recycling material such as aluminum, but heretofore the packaging for securing the beverage containers have been formed contemporarily of a polymeric, flexible web including a series of circumferential bands to frictionally adhere and secure the containers therewithin. These bands are disposed and due to their polymeric construction, do not decompose and are accordingly difficult to dispose or recycle. The instant invention attempts to overcome prior art container packaging arrangements wherein the same provides a packaging container construction enabling its interweaving with associate packaging containers to form netting for use in tennis courts, hammocks, fruit, plant or vegetable support, and the like. Examples of the prior art packaging arrangements include U.S. Pat. No. 3,785,484 to Cunningham setting forth a multiapertured package stretchable to overlie and secure containers therewithin.

U.S. Pat. No. 3,744,626 to Dreyfus sets forth a packaging container formed of a webbed shape material with apertures and bands therethrough and formed with a central handle for transport of the containers therewithin.

U.S. Pat. No. 3,630,350 to Bolton sets forth a packaging container utilizing a polygonal retainer element formed with nodules for securement of the containers therewithin.

U.S. Pat. No. 4,372,598 to Quelch sets forth a flexible, polymeric container wherein concentric openings are arranged to receive bottles and the like therethrough.

U.S. Pat. No. 4,190,149 to Oliff sets forth an article carrier of a unitary blank formed with apertures and anchoring tabs whereupon bottles projected through the apertures and circumferentially oriented tabs secure a bottle in association with the bottle caps.

As such, it may be appreciated that there is a continuing need for a new and improved packaging container, and particularly a net forming method, wherein an improved packaging container is securable to associate containers to form netting therefrom for reclamation and recycling of the container.

SUMMARY OF THE INVENTION

In view of the foregoing disadvantages inherent in the known types of container packages now present in the prior art, the present invention provides a container package and net forming method wherein the same provides an improved container package for securement to associate container packages to form a net. As such, the general purpose of the present invention, which will be described subsequently in greater detail, is to provide a new and improved container package and net forming method which has all the advantages of the prior art container packages and none of the disadvantages.

To attain this, the container package and net forming method of the instant invention comprises an improved container package wherein a series of pairs of adjacent circumferential bands formed of elastic, polymeric material are positioned for reception of plural pairs of cylindrical containers therewithin. The packages include interconnecting webs and associated expansion apertures to enable expansion of the webs, wherein each of the circumferential bands includes a diametrically aligned first and second strap respectively relative to adjacent circumferential bands, wherein the end bands include further straps for enabling securement to adjacent container packages. The straps are of two categories including a first category utilizing an elongate strap, and a second category wherein the straps are provided with buckle members for reception of the first straps therewithin. The containers are secured relative to one another wherein the buckles receive associate straps to provide for a matrix of such containers to develop a net therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore a object at the present invention to provide a new and improved net forming method which has all the advantages of the prior art container packages and none of the disadvantages.

It is another object of the present invention to provide a new and improved net forming method which may be easily and efficiently manufactured and marketed.

It is a further object of the present invention to provide a new and improved net forming method which is of a durable and reliable construction.

An even further object of the present invention is to provide a new and improved net forming method which is susceptible of a low cost of manufacture with regard to both materials and labor and which accordingly is then susceptible of low prices of sale to the consuming public, thereby making such net forming methods economically available to the buying public.

Still yet another object of the present invention is to provide a new and improved net forming method which provides in the apparatuses and methods of the prior art some of the advantages thereof, while simultaneously overcoming some of the disadvantages normally associated therewith.

Still another object of the present invention is to provide a new and improved net forming method wherein the same sets forth an improved container package that is securable to adjacent container packages for developing a net arrangement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic view taken in elevation of the net developed by the instant invention secured to spaced poles to provide a playing net.

FIG. 6 is an orthographic view taken in elevation of the net developed by the instant invention mounted to provide a hammock construction.

DESCRIPTION OF THE PREFERRED EMBODIMENT

Figure 1:
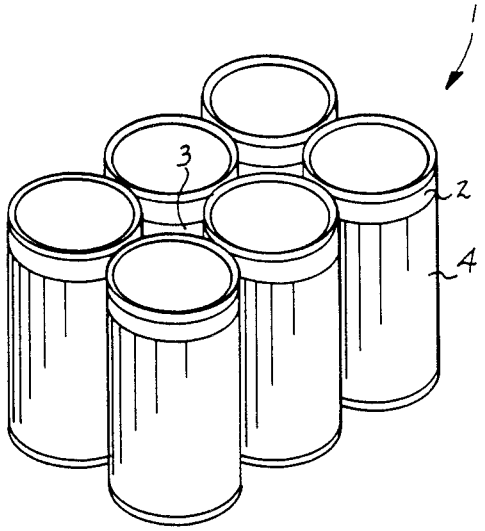
FIG. 1 is an isometric illustration of a prior art container package.
Figure 2:
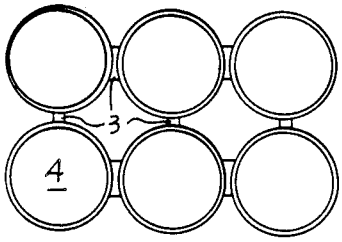
PRIOR ART FIG 2
FIG. 2 is a top orthographic view of a prior art container package.

With reference now to the drawings, and in particular to FIGS. 1 to 6 thereof, a new and improved net forming method embodying the principles and concepts of the present invention and generallY designated by the reference numerals 10 and 20 will be described.

More specifically, the net forming method of the instant invention comprises an improvement over the prior art packaging containers set forth by a prior art container 1 provided with a series of pairs of adjacent cylindrical flexible bands with connecting webs 3 therebetween to receive cylindrical cans 4 therewithin.

Figure 3:
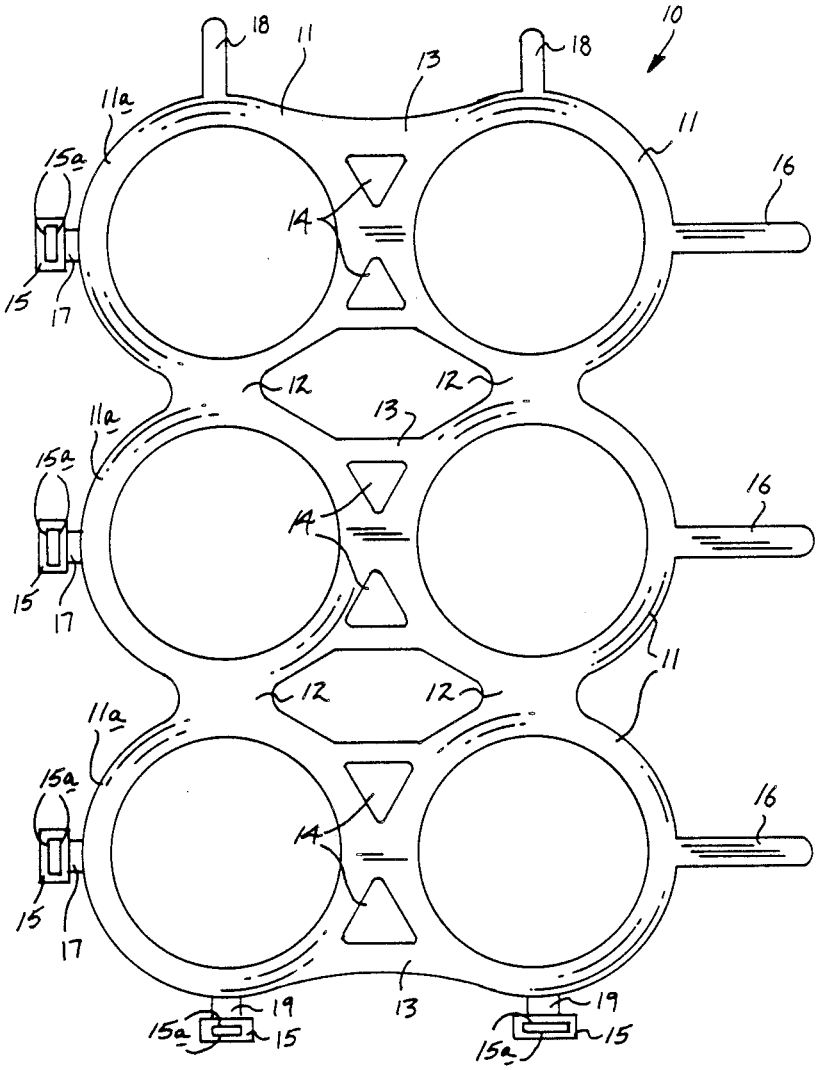
FIG. 3 is a top orthographic view of the improved container package of the instant invention.
Figure 4:
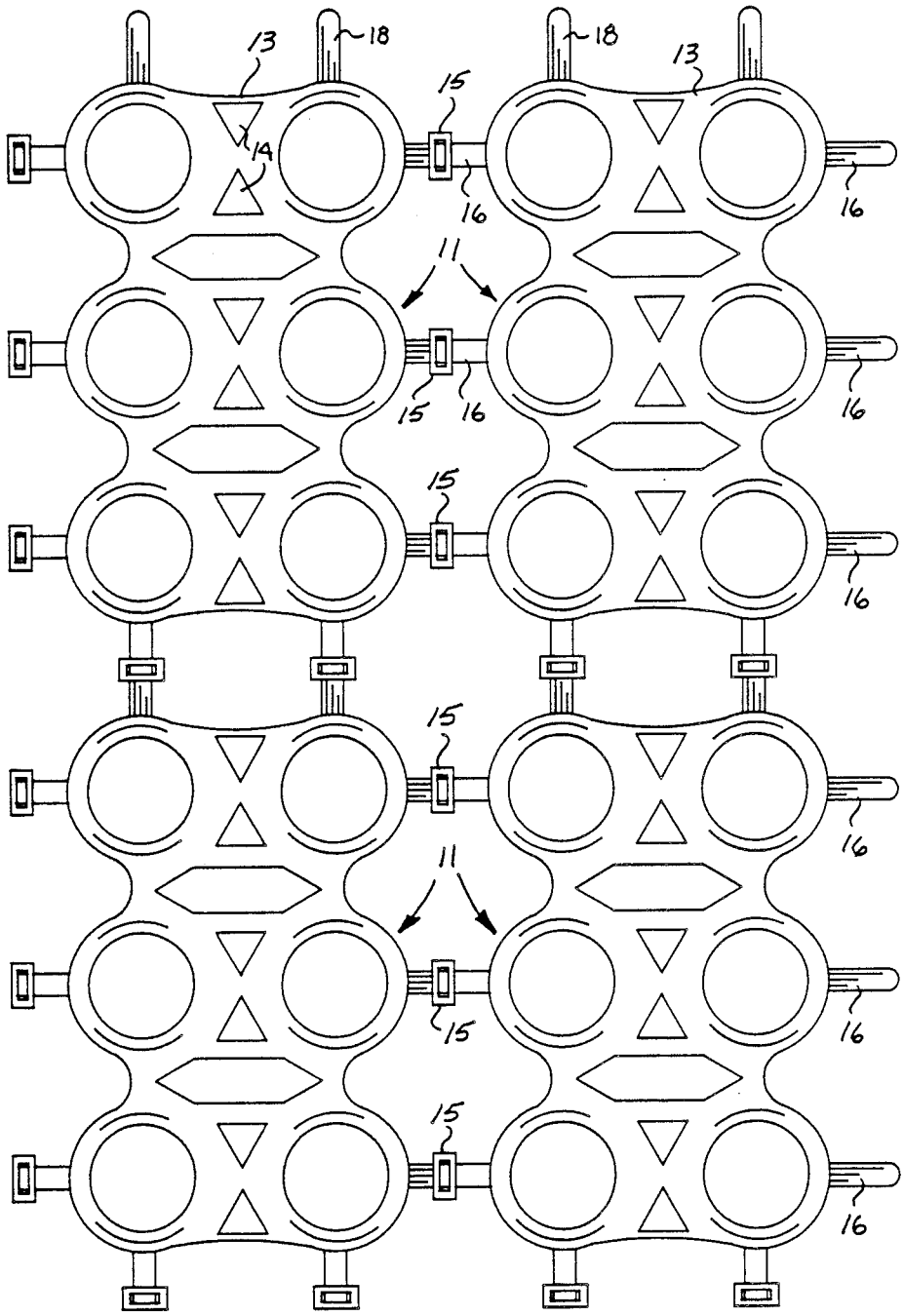
FIG. 4 is a top orthographic view of the container package of the instant invention secured to adjacent container packages for developing a net matrix of such packages.

The net forming method of the instant invention includes an improved container package 10 formed with plural pairs of aligned, circular circumferential bands 11 to define a rectangular matrix, wherein the bands are diametrically aligned in adjacent and overlying relationship relative to one another. The vertically stacked circumferential bands 11, as well as the second horizontally stacked bands **11*a* are secured together by solid vertical connecting webs 12. The spaced adjacent and horizontal circumferential bands 11 and 11*a* defining respective pairs of circumferential bands are connected by horizontal connecting webs 13 that are formed with a plurality of expansion apertures 14 therebetween to enable expansion of the flexible, polymeric bands 11 about an associate beverage container positioned within each of the defined apertures of the bands. It should be noted that the container package 10 is formed of a single sheet of flexible, polymeric material to accommodate flexure and use of the package. The first group of circumferential bands 11 are provided with diametrically aligned and outwardly extending first straps of a first length spaced in the same plane but extending exteriorly and diametrically of each of the circumferential bands 11, wherein second straps 17 are diametrically aligned with the first straps 16 and extend exteriorly of the second group of circumferential bands 11*a* and are of a second length. Third straps 18 extend diametrically and orthogonally relative to the first and second straps 16 and 17 and spaced upwardly of the upper bands 11 and 11*a* and are of a first length, wherein fourth straps 19 of a second length extend in aligned relationship relative to the third straps 18 and below the bottom circumferential bands 11 and 11*a*, as illustrated in FIG. 3. It should be noted that the first length is greater than that defined by the second length and wherein each of the second and fourth straps are formed with a buckle member 15 at a terminal end thereof, wherein the buckle member includes a plurality of spaced slots 15*a* for frictional reception and securement of the respective first and third straps of associate containers. A matrix of such containers so joined is illustrated in FIG. 4 defining a net 20 formed of a matrix of the container packages 10 with the buckles 15 receiving the free terminal ends of the associated first and third straps 16 and 18**.

FIG. 5 illustrates a rectangular net formed of a matrix of the container packages 10 wherein the peripheral first, second, third, and fourth straps that extend beyond the periphery of the so-formed net 20 are severed and removed to provide a finished perimeter. Similarly, a net **20*a* is configured to define an elliptical hammock shaped net, as illustrated in FIG. 6, wherein the nets 20 and 20*a* of FIGS. 5 and 6 respectively are formed of respective securement corner straps 21 and hammock straps 22** formed at respective corners and apexes of the so-formed nets for securement to associated poles or trees, as is required for support of the netting.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes willreadily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A method of forming a net comprising the steps of, (1) providing a plurality of beverage container holders wherein each beverage container holder is formed of a single, flexible polymeric blank, and wherein each beverage container holder is formed with plural pairs of adjacent circumferential beverage container holder encompassing bands defining right and left columns of vertical bands, and each beverage container holder including first connecting webs between adjacent vertical bands within said right and left columns, and each beverage container holder further including second webs between pairs of adjacent horizontal right and left bands, and (2) providing first connecting straps directed exteriorly of said right bands, and providing second straps directed exteriorly of said left bands, and simultaneously providing third straps extending exteriorly of top right and left bands of said right and left columns of bands, and simultaneously providing fourth connecting straps directed downwardly of bottom bands of said right and left columns of bands, and providing connector members at terminal ends of said second straps and said fourth straps, and (3) forming a matrix of said beverage container holders wherein the beverage container holders are secured together, wherein the first straps of an individual beverage container holder is secured to adjoining second straps of a second beverage container holder, and the third straps of a first beverage container holder are secured to fourth straps of a third beverage container holder and the fourth straps of the first beverage container holder are secured to the third straps of a fourth beverage container holder, and the second straps of the first beverage container holder are secured to first straps of a fifth beverage container holder.

2. A method of forming a net as set forth in claim 1 wherein the step of providing a plurality of beverage container holders includes the step of simultaneously providing the first connecting webs as solid webs and providing the second connecting webs with a plurality of expansion apertures therewithin between adjacent horizontal bands of the right and left columns of bands.

3. A method of forming a net as set forth in claim 2 further including the step of providing a plurality of slots in the connector members at terminal ends of the second and fourth straps, wherein the slots receive and interlock free terminal ends of first and third bands of the second and third beverage container holders.

4. A method of forming a net as set forth in claim 3 further including the step of providing securement straps at corner portions of the net to enable securement of the net to spaced support stands.

5. A method of forming a net as set forth in claim 4 further including the step of severing selective first, second, third, and fourth straps about a periphery of the formed net.

* * * * *